US008056940B2

(12) United States Patent
Morgan et al.

(10) Patent No.: US 8,056,940 B2
(45) Date of Patent: Nov. 15, 2011

(54) PIPE CONNECTOR DEVICE

(75) Inventors: David James Edward Morgan, Aberdeen (GB); David Malcolm Sinclair, Aberdeen (GB)

(73) Assignee: Oil States Industries (UK) Ltd., Aberdeen (GB)

( * ) Notice: Subject to any disclaimer, the term of this patent is extended or adjusted under 35 U.S.C. 154(b) by 0 days.

(21) Appl. No.: 12/990,124

(22) PCT Filed: May 28, 2009

(86) PCT No.: PCT/GB2009/001341

§ 371 (c)(1), (2), (4) Date: Oct. 28, 2010

(87) PCT Pub. No.: WO2009/156708

PCT Pub. Date: Dec. 30, 2009

(65) Prior Publication Data

US 2011/0068574 A1 Mar. 24, 2011

(30) Foreign Application Priority Data

Jun. 27, 2008 (GB) ..... 0811846.5

(51) Int. Cl.
*F16L 25/00* (2006.01)

(52) U.S. Cl. ..... 285/382.2; 285/333; 285/332.1

(58) Field of Classification Search ..... 285/333, 285/332.1, 332, 331, 382, 382.2
See application file for complete search history.

(56) References Cited

U.S. PATENT DOCUMENTS

| | | | | | |
|---|---|---|---|---|---|
| 4,298,221 | A | * | 11/1981 | McGugan | 285/332.4 |
| 4,601,491 | A | * | 7/1986 | Bell et al. | 285/334 |
| 4,629,221 | A | * | 12/1986 | Lumsden et al. | 285/331 |
| 4,648,627 | A | * | 3/1987 | Reimert | 285/334 |
| 4,892,337 | A | * | 1/1990 | Gunderson et al. | 285/333 |
| 5,044,676 | A | * | 9/1991 | Burton et al. | 285/334 |
| 5,261,493 | A | * | 11/1993 | Brammer | 285/921 |
| 5,954,374 | A | * | 9/1999 | Gallagher et al. | 285/332 |
| 5,964,486 | A | * | 10/1999 | Sinclair | 285/331 |
| 6,056,324 | A | * | 5/2000 | Reimert et al. | 285/334 |
| 6,106,024 | A | * | 8/2000 | Herman et al. | 285/333 |

FOREIGN PATENT DOCUMENTS

| | | | |
|---|---|---|---|
| EP | 0 570 028 | A2 | 11/1993 |
| EP | 0 803 637 | A2 | 10/1997 |
| GB | 2 033 518 | A | 5/1980 |
| GB | 1 573 945 | | 8/1980 |
| GB | 2 099 529 | A | 12/1982 |
| GB | 2 113 335 | A | 8/1983 |
| GB | 2 138 089 | A | 10/1984 |
| WO | 2003/032331 | A2 | 4/2003 |
| WO | 2004/023014 | A2 | 3/2004 |
| WO | 2006/027276 | A1 | 3/2006 |

* cited by examiner

*Primary Examiner* — David E Bochna
(74) *Attorney, Agent, or Firm* — Baker & Hostetler LLP

(57) ABSTRACT

A pipe connector comprises a tubular pin member having a frustoconical outer surface and a tubular box member having a frustoconical inner surface corresponding to the outer surface of the pin member and which overlies the frustoconical surface of the pin member when the members are fully engaged. The members are provided with inter-engageable annular projections and grooves on the said peripheral surfaces for axially locking the members together when they are fully engaged together. The projections and grooves are spaced apart along the surfaces. The inner tubular surface of the pin member and an outer tubular surface of the box member each include at least one of a recess and/or a protrusion/radially enlarged section which reduces and/or increases the thickness of the tubular wall along the length of the associated member so as to balance the displacement of the members at different points along the length thereof under injection pressure.

16 Claims, 5 Drawing Sheets

Crest relief (prior art system)

External Profile (Present Invention)

(a) Relative radial displacement under break-out injection pressure (b) Nominal radial tooth engagement versus position (c) Radial Clearance during disassembly (effective case 2(a) – Case 2(b)

PIPE CONNECTOR DEVICE

CROSS-REFERENCE TO RELATED APPLICATIONS

This application is a National Stage of International Patent Application No. PCT/GB2009/001341, filed on May 28, 2009, which claims priority to foreign Patent Application No. GB 0811846.5, filed on Jun. 27, 2008, the disclosures of which are incorporated herein by reference in their entirety.

FIELD OF THE INVENTION

The present invention relates to improvements in pipe connectors particularly but not exclusively for use in the oil industry for connecting metal pipe sections of pipe strings.

BACKGROUND OF THE INVENTION

So called Merlin type pipe connectors are well known in the art for connecting pipes together and are disclosed in GB1573945, GB2033518, GB2099529, GB2113335 and GB2138089. The connection is formed by tubular pin member having a frustoconical outer peripheral surface and a tubular box member having a generally frustoconical inner peripheral surface corresponding to the frustoconical outer peripheral surface of the pin member. In use, the two members, each associated with a pipe section, are telescoped together and are axially locked together by mating annular projections and grooves provided on the said peripheral surfaces, the projections and grooves being spaced apart along the two surfaces.

In telescoping the two members together, they are initially telescoped until surface contact is made between crest surfaces of the projections and surfaces between the grooves at least at the ends of the overlapped portions of the surfaces. Hydraulic fluid under pressure is then typically supplied between the overlapped parts of the surfaces to expand the box member and/or contract the pin member to permit the members to be fully telescoped together or the members may simply be pushed together. Pressurised hydraulic fluid is also used to disengage the members by expanding the box member and/or contracting the pin member to bring the projections out of engagement with the corresponding grooves.

In order to reduce the axial extent of the members, projections and grooves may be provided which have relatively small axial extents but this means that, to fully telescope the members together after they have been brought into initial contact, it is necessary to move individual projections past at least one groove before each projection is aligned with the groove in which it is designed to engage. In doing this, there is a risk that the projections and grooves may inter-engage before the members are fully telescoped together and it may then prove impossible to disengage the projections and grooves. To avoid this, prior are systems have proposed forming some at least of the projections and grooves with different axial extents so that the projections and grooves cannot inter-engage before the members are fully engaged. The arrangement is such that in all intermediate positions of the members, prior to full engagement and after the frustoconical surfaces have been brought into initial surface contact, there is contact between the crests of at least some of the projections and surfaces between the grooves spaced apart along the overlying parts of the frustoconical surfaces.

These prior art connectors have the problem, however, that when disengaging the members using pressurised hydraulic fluid, to ensure that the projections and grooves at the end of the surfaces of the members overcome the radial restrain and disengage completely, the radial loading imposed by the pressurised fluid on the central portion of the surfaces of the members is substantially greater than is needed to disengage the projections and grooves in these sections. This can result in the elastic limit of the material of the connectors parts in these sections being exceeded, permanently deforming the parts and hence preventing re-use. This problem has been overcome by making the members out of high tensile steel, but this significantly increases cost.

Applicant's own earlier European patent EP 0803637 discloses a solution to this problem in which the radial height of the projections is reduced towards the free end of each member so that the engagement depth of those projections in the grooves is reduced. In particular, the radial height of the projections taper inward towards the free end of each member. This decreases the depth of engagement of the teeth in the grooves, so as to provide sufficient clearance of the end teeth during break-out to enable disengagement at a lower pressure while keeping the average tooth engagement relatively high. In this way, the risk of over-pressurising the members beyond the elastic limit of the material in the middle of the connector is reduced.

The system has the drawback, however, that the teeth crests are no longer aligned on a single cone and uneven crest profile causes contact pressure high points during assembly, which can lead to excessive local wearing of the teeth. Moreover, tapering the teeth crests at the ends compromises the metal-metal seal between the end teeth during make-up of the joint, meaning that a high viscosity injection fluid is required to enable the high injection pressure required for a smooth make-up.

SUMMARY OF THE INVENTION

According to one aspect of the present invention, there is provided a pipe connector comprising a tubular pin member having a generally frustoconical outer peripheral surface and a tubular box member having a generally frustoconical inner peripheral surface corresponding to the frustoconical outer peripheral surface of the pin member and which overlies the frustoconical surface of the pin member when the members are fully engaged together, the members being provided with inter-engageable annular projections and grooves on the said peripheral surfaces for axially locking the members together when they are fully engaged together, the projections and grooves being spaced apart along the surfaces, means for supplying hydraulic fluid under pressure between the overlying parts of the surfaces of the members when fully engaged together to expand the box member and/or contract the pin member to bring the projections out of engagement with the corresponding grooves and permit the members to be disengaged, and means for radially restraining the free end of one of the members of the connector, characterised in that at least one of the inner tubular surface of the pin member and the outer tubular surface of the box member includes at least one of a recess and a protrusion/radially enlarged section which reduces and/or increases the thickness of the tubular wall along the length of the at least one member so as to balance the displacement of the at least one member at different points along the length thereof under injection pressure.

A pipe connector in accordance with the invention has the advantage that the removal and/or addition of material from the surfaces opposite to the projections/grooves on each member adjusts the displacement response of the members, enabling higher displacement to be achieved at the end for any particular pressure. The displacement may therefore be better balanced between the middle of the grooves/projections and the ends, thereby enabling release of the connector at lower pressure and hence avoids over-pressuring. The system therefore avoids the use of variable radial overlap of the teeth, increasing the strength capacity due to increased tooth engagement at the extremities. Improved temporary sealing is also achieved resulting in smoother make-up and break-out, thereby reducing wear, less viscous and more environmentally friendly injection fluids can be used for break-out and machining and inspection requirements during manufacture of the members are simplified, reducing costs.

Preferably, the at least one recess or protrusion is formed by inwardly and outwardly tapering sections in the respective surface of the respective member. In particular, a first section of the inner surface of the pin member, which extends across a root end of the grooves/projections carried on the pin member, tapers outwards and then back inwards so as to form a substantially V shaped channel recessed in the inner tubular surface, which channel extends around the entire periphery of the pin member. The taper angle of the outwardly tapering portion of the first section, which is preferably 7.1 degrees, is advantageously shallower that the taper angle of the inwardly tapering portion of the first section, which is preferably 8.85 degrees.

The taper angle of the outwardly tapering portion of the first section is preferably steeper than the cone angle of the outer frustoconical surface of the pin member formed by the crests of the projections/grooves, preferably said cone angle being substantially 4 degrees.

In a preferred embodiment, the inner surface of the pin member includes a second section proximate to the tip of the pin member in which the radius of the inner surface is decreased so as to increase the thickness of the tubular wall of the pin member, said second section preferably being formed by a steeply tapering reduction in the radius of the inner surface followed by a cylindrical portion which extends towards the tip, forming a flat on the inner surface of reduced radius.

The outer surface of the box member preferably has a first inwardly tapering portion extending from the root tip-wards, and a second outwardly tapering portion which extends from the end of the first portion towards the tip, the taper angle of said first portion being steeper than the taper angle of said second portion, preferably substantially 7 degrees and 2.8 degrees respectively, said second portion being substantially longer than said first portion. The radial extent of the second portion is preferably greater than the radial extent of the first portion, such that second portion terminates at a greater radius than the start of the first portion. The outer surface of the box member advantageously further includes a third, cylindrical portion, which extends from the tip-wards end of the second portion across the tip end of the projections/grooves formed on the inner surface of the box member.

The taper angle of the second section is preferably smaller than the taper angle of the crests of the projections/crests carried on the box member, which preferably have a taper angle of substantially 4 degrees.

BRIEF DESCRIPTION OF THE DRAWINGS

In order that the invention may be well understood, there will now be described an embodiment thereof, given by way of example, reference being made to the accompanying drawings, in which.

DETAILED DESCRIPTION

Figure 1:
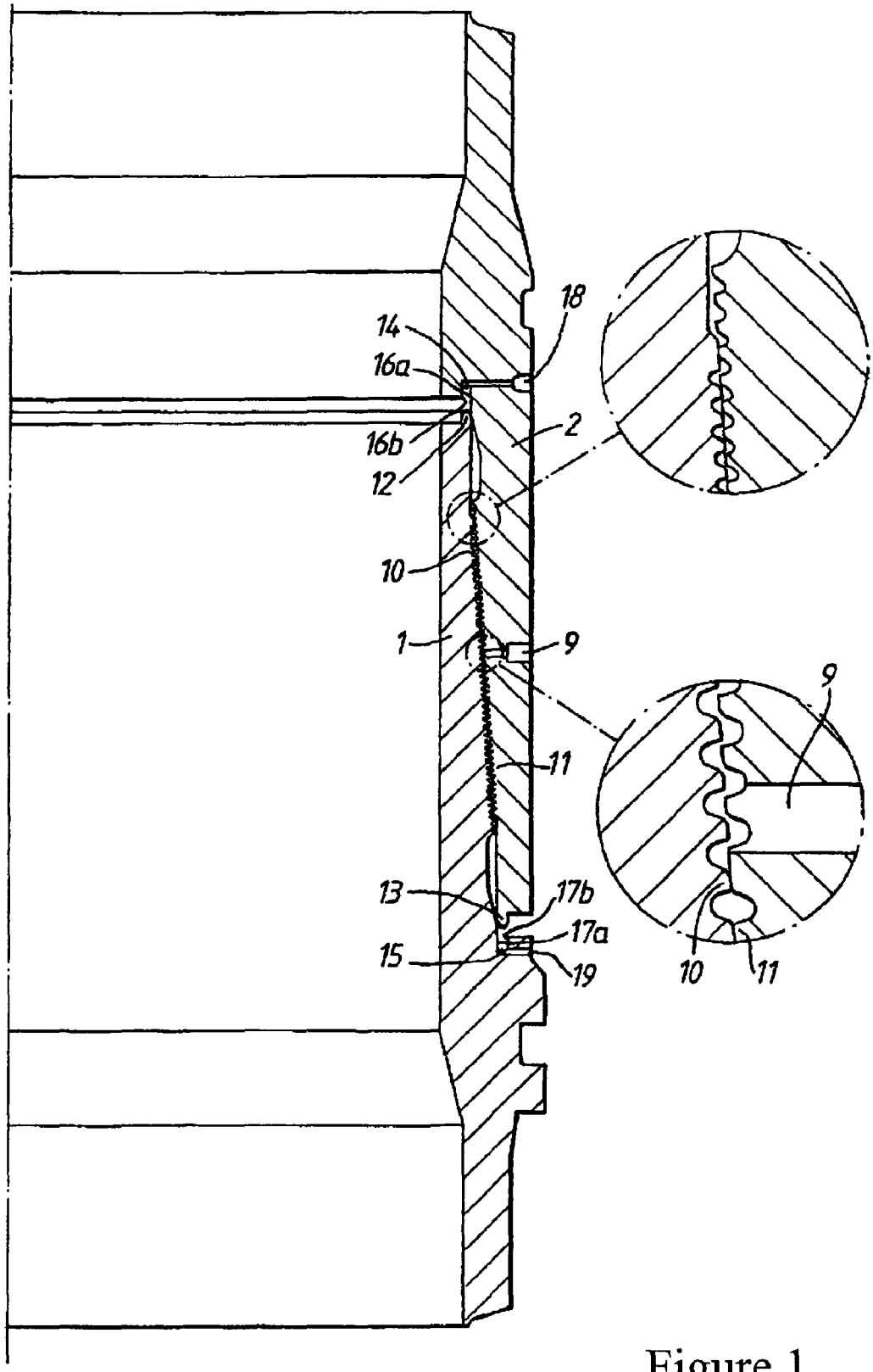
FIG. 1 is an axial section through a pipe connector of the prior art showing the members in their initial telescoped together positions.
Figure 2:
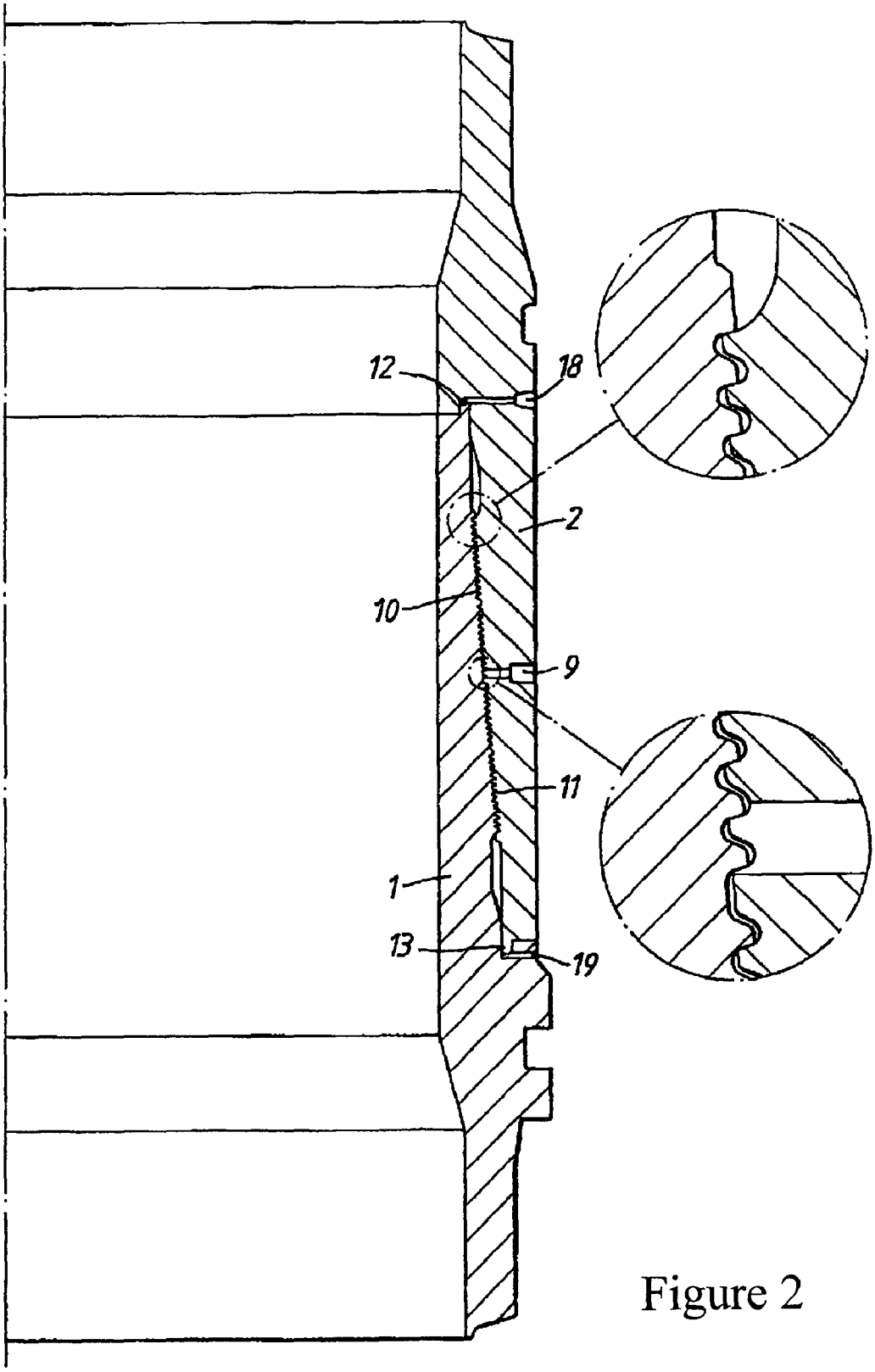
FIG. 2 is a section similar to that of FIG. 1 but showing the prior art connector with the members fully engaged together.

Referring first to FIGS. 1 and 2, there is shown a prior art pipe connector comprising a tubular pin member 1 and a tubular box member 2, which are connected, or to be connected e.g. by welding, to the ends of two pipes. The members are designed to be telescoped together, the outer surface 3 of the pin member 1 and the inner surface 4 of the box member 2 being both generally frustoconical and provided with complementary annular projections 5 and grooves 6 which are axially spaced apart along the lengths of the surfaces intermediate the ends of the surfaces. The projections and grooves are relatively dimensioned so that, when the members are fully engaged together, corresponding ones of the projections inter-engage in the grooves to axially lock the members together. Pin member 1 is described herein as having projections 5 and box member 2 as having grooves 6, but it will be understood that these descriptions can be reversed.

Engagement of the members takes place in two stages. Initially, the members are brought together until contact is established between crest surfaces 7 of the projections 5 and surfaces 8 between the grooves 6. Thereafter, force is applied axially to complete engagement of the members. At the end of the first stage, a projection may yet have to pass over a plurality, for example three or four, grooves before it reaches its corresponding groove in which it is to engage. With this arrangement, to prevent inadvertent engagement of a projection with a groove which is not its corresponding groove, i.e. before the members are fully telescoped together, corresponding pairs of projections and grooves may be provided with differing axial extents and spacings along the length of the surfaces 3, 4. The projections 5 and grooves 6 are then arranged, for example as described in GB 2113335, so that at intermediate positions during telescoping of the members 3, 4, after the members have been brought into initial contact, at least some of the crest surfaces 7 of projections 5 spaced along the length of the surface 1 and intermediate the ends of the overlapped portions of the surfaces 3, 4, are aligned with surfaces 8 between the grooves, to prevent premature inter-engagement of the projections and grooves over any substantial length of the overlapped portions of the surfaces.

The arrangement and axial dimensioning of the spaced annular projections and grooves to prevent intermediate inter-engagement of the projections and grooves can be obtained in any number of different ways, for example as described in GB2113335.

After the members have been telescoped together to their initial positions, they may be fully engaged by simply applying an axial force to the members. Engagement may however be assisted, and the members may also be disengaged, by the application of pressurised hydraulic fluid between the overlapped portions of the surfaces. This pressurised fluid exerts radial loading on the overlapping surfaces, expanding the box and/or contracting the pin to create a clearance between the projections and the grooves so as to permit engagement and disengagement. The pressurised fluid also acts to lubricate the crest surfaces 7 of the projections 5 and surfaces 8 between the grooves 6 to facilitate sliding of these surfaces over one another.

As shown in the Figures, the box member 2 is provided with a radial duct 9 for connection to a source of pressurised hydraulic fluid to enable pressurised fluid to be introduced between the overlapping members. The duct 9 opens inwardly of the box into the region of the frustoconical surface 4 of the box which is provided with the projections or grooves. In order to facilitate penetration of the pressurised fluid along the whole overlapping length of the members, axially extending grooves 10, 11 are provided, one in the pin member 1 and the other in the box member 2, which intersect the projections and grooves respectively, the duct 9 opening into the groove 11 in the box member.

To ensure sealing at the ends of the frustoconical surfaces 3, 4 of the members and to guard against any inadvertent escape of the pressurised hydraulic fluid from between the members during disengagement of the members, sealing means may be provided at or adjacent the ends of the frustoconical surfaces 3, 4 and the sealing means may be provided in conjunction with means radially restraining the free ends of the members. As shown, the sealing and radially restraining means comprise an annular axially extending nib or projection 12, 13 provided at the free end of each member and which is received in a corresponding groove 14, 15 at the inner end of the frustoconical surface of the other member, and, as shown, seals laterally against surface portions 16*a* and 16*b*, 17*a* and 17*b* of the groove of the other member, surface portions 16*a*, 16*b*, 17*a* and 17*b* being provided with appropriate tapers for this purpose. In effect, each nib 12, 13 is in full interference fit in its corresponding groove 14, 15, when the members are fully engaged together. Surface portions 16*a* and 17*a* are extended along the surfaces of the members so that the nibs 12, 13 make sealing contact with these surfaces before the members are fully engaged and. indeed, in their initial telescoped positions to provide seals at the ends of the overlapped portions of the frustoconical surfaces during assembly of the members. Ducts 18, 19 connecting the bottoms of the grooves 14, 15 with the exterior of the members are provided to allow hydraulic fluid to bleed away during assembly of the connector to ensure that the fluid does not become trapped between the members and thus prevent full engagement. Sealing between the nibs and the grooves may alternatively be achieved in a variety of different ways, for example, as described in GB2138089.

As clearly shown in FIGS. 1 and 2, in the prior art system, the wall thickness of each of the members tapers linearly inwards towards the free end of the respective connector so as to be thinnest at the free end. In order, then to prevent overpressuring of the material, the extent of the radial overlap at full engagement of at least the end projections and grooves in the region of the or each free end of the or each member which is radially restrained, is reduced with a view to reducing the pressure of the hydraulic fluid required to disengage the members. As shown, the reduction in radial overlap is obtained by reducing the radial extents of the projections in an end portion at least of the part of the surface of the pin member provided with the projections, and the radial depths of the grooves in an opposite end portion at least of the part of the surface of the box member provided with the grooves.

Figure 3:
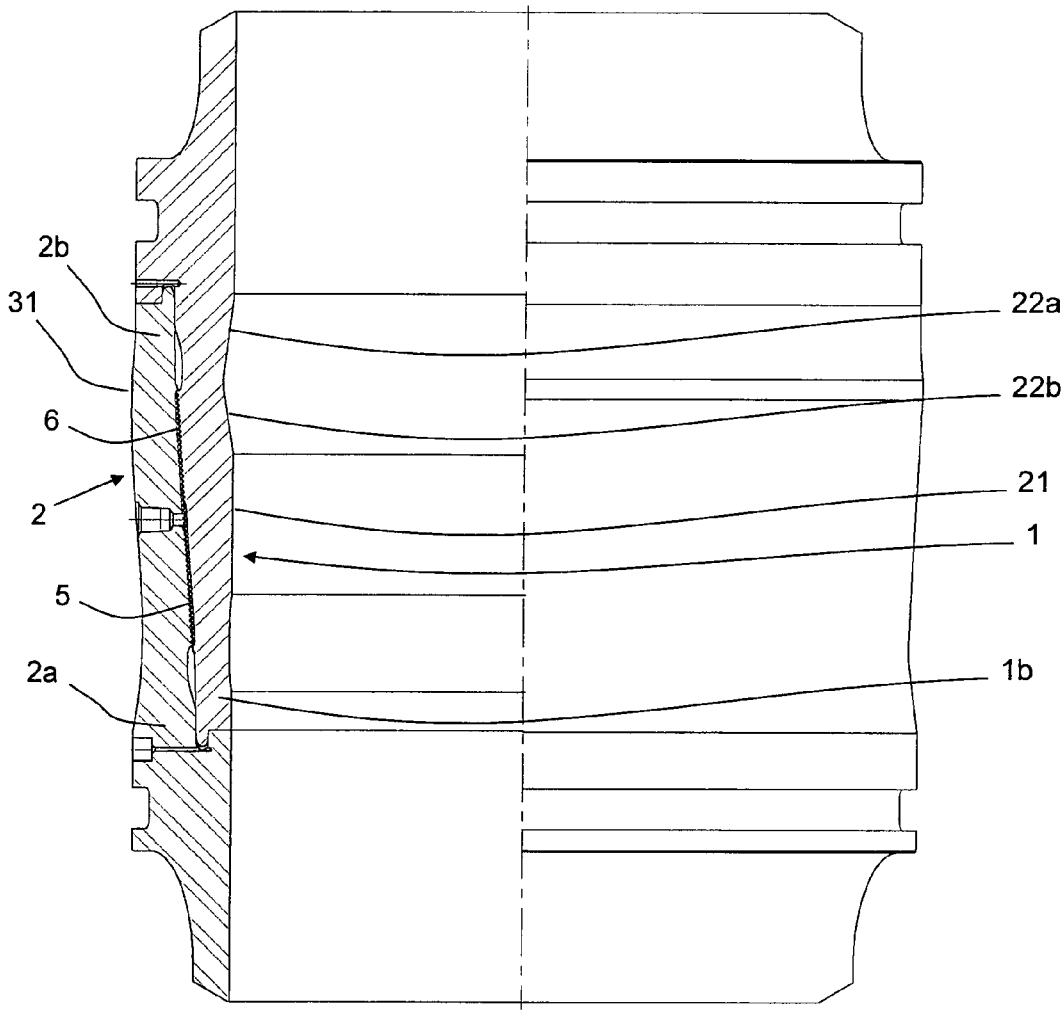
FIG. 3 is a section corresponding to FIG. 2 showing a pipe connector according to the invention with the members thereof fully engaged.
Figure 4A:
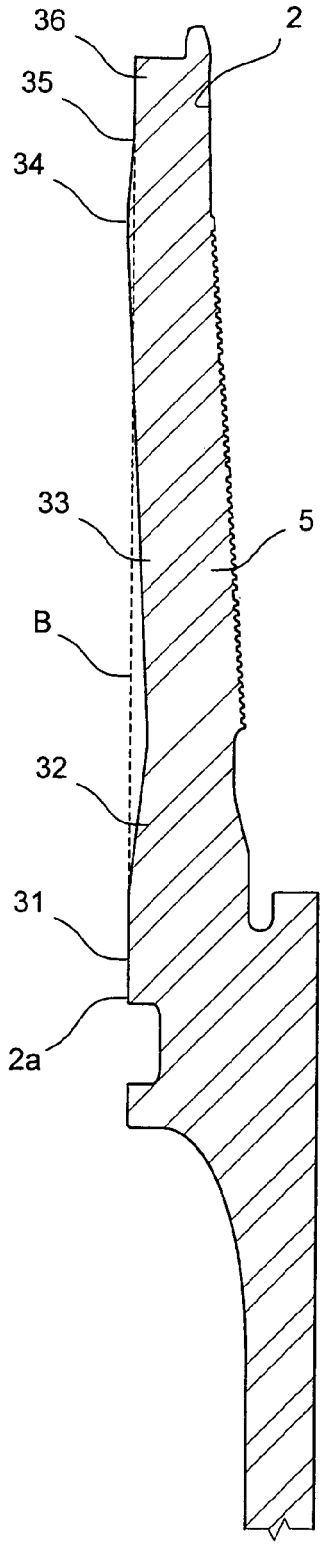
FIG. 4*a* is an enlarged sectional view of part of a box member which forms part of the connector of the present invention.
Figure 4B:
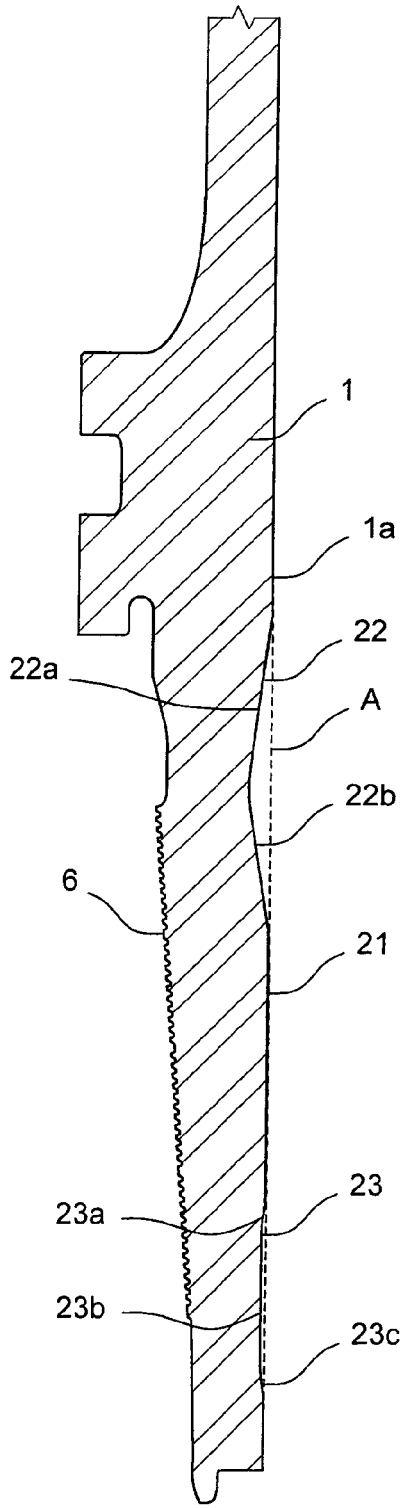
FIG. 4*b* is an enlarged sectional view of part of a pin member which forms part of the connector of the present invention.

Referring now to FIGS. 3 to 4*b*, there is shown a connectors according to the present invention in which all like parts compared with the prior art system of FIGS. 1 and 2 are identified using the same reference number, and unless otherwise states, will be understood to operate in the same fashion as the above described prior art system.

It will be seen that the profile of the inner surface 21 of the tubular pin member 1 and the profile of the outer surface 28 of the tubular box member 2 have been modified from the cylindrical surfaces of the prior art in the region of the projections 5 and grooves 6, as compared with the prior art system, so that the thickness of the wall of each member 1, 2 no longer tapers continuously inwardly towards the free end of the respective connector as in the prior art systems. In the case of the pin member 1, material has been removed from the inner surface 21 at both ends of the projections 5, and in the case of the box member 2, material has been added to the outer surface proximate to the free end of the connector and removed from other end.

FIG. 4*b* shows, in more detail, the profile of the pin member 1 according to the invention, with the broken line A in FIG. 4*b* indicating the cylindrical inner surface of the prior art connector as a comparison. Starting at the root end 1*a* of the pin member (remote from the tip 1*b*), the inner surface 21 is generally cylindrical but deviates away from the conventional cylindrical profile at two sections, a first section 22 which overlaps with the root end of the grooves 6/projections 5 and a second section 23 which overlaps the tip end of the grooves 6/projections 5.

The first section 22 is formed by an outwardly tapering frustro-conical section 22*a* connecting to an inwardly tapering frustro-conical section 22*b*, the two sections together forming a V-shaped depression in the inner profile which extends around the entire periphery, the inwardly tapering section finishing at the same radius as the outwardly tapering section starts at. It will be seen, however, that the cone angle of the outwardly tapering section 22*a* is shallower than that of the inwardly tapering section 22*b*—in the illustrated embodiment, the outwardly tapering section has a taper angle of 13.90 degrees whilst the inwardly tapering section has a taper angle of 17.15 degree, and increasing the radius of the inner surface 21 of the pin member 1 by approximately 3.6%. The whole first section 22 has a longitudinal extend of approximately 38% of the operative length of the pin member.

The first section 22 is located so that the transition from the outwardly tapering section to the inwardly tapering section is substantially aligned with the root end of the projections 5/grooves 6 so that the wall thickness in the region of the first section 22 is at a minimum at the root end of the grooves/projections.

The second section 23 is formed by a short outwardly tapering frustro-conical section 23*a* having a ramp angle of 20.8 degrees which connects to a cylindrical section 23*b*, the outwardly tapering section 23*a* increasing the radius of the inner profile by approximately 0.62%. The cylindrical section 23*b* extends towards the tip 1*b* of the pin member 1, overlying the tip end of the projections/grooves, and terminates at an inwardly tapering frustro-conical section 23*c* which returns the inner profile to the original radius. In the illustrated embodiment, the longitudinal extent of the cylindrical section is approximately 18% of the operative length of the pin member 1.

Referring now to FIG. 4*a*, there is shown, in more detail, the profile of the box member 2 of the invention, with the broken line B in FIG. 4*a* indicating the cylindrical outer surface of the prior art box member 2. Starting at the root end 2*a* of the box member 2 (remote from the tip 2*b*), the outer surface 31 follows the conventional cylindrical profile before tapering radially inwardly, starting rootwards of the start of the grooves/projections 5, so as to reduce the wall thickness of the box member 2 towards the root end of the projections/grooves 5 in a first frustoconical section 32. In the preferred embodiment, the first frustoconical section 32 has a cone angle of 7.02 degrees, extends along approximately 18% of the operative length of the box member 2, that is the length of the box member which overlaps with the pin member 1, and results in a reduction in the radius of the outer surface of the box member 2 of approximately 2.4%.

The first, inwardly tapering frustoconical section 32 links to a second, outwardly tapering frustoconical section 33, the transition from the first to the second sections 32, 33 defining a minimum in the radius of the outer surface 31 of the box member 2 which is located longitudinally just before the start of the projections/grooves 5 formed on the inner surface of the box member 2. The taper angle of the second section 33 is less than that of the first section 32, and is also less than the taper angle of the surface defined by the tooth crests of the projections/grooves 5 formed on the inner surface of the box member 2 so that the wall thickness of the box member 2 reduces towards the tip of the box member 2. In the illustrated embodiment, the tooth crests define a taper angle of approximately 4 degrees whilst the second frustoconical section 33 has a cone angle of substantially 2.8 degrees.

The outwardly tapering second section 33 continues towards the tip 2*b* of the box member 2, extending outside the radius of the outer surface of the root 2*a* and of the conventional profile (B) so as to effect a radial thickening of the annular wall of the box member in the region of the tip end of the projections/grooves 5 as compared with the conventional design. A third cylindrical section 34 proceeds from the tip end of the second section, extending across the tip end of the projections/grooves before tapering back down in a fourth, inwardly tapering frustoconical section 35 to a radius equal to the root radius and thence continuing to the tip of the box member in a fifth cylindrical section 36 as the root radius, that is following the conventional profile. In the illustrated embodiment, the second section extends along approximately 60% of the operative length of the box member 2, the third cylindrical section approximately 4.8% of the operative length, the fourth section approximately 8.45% and the fifth section approximately 9% of the operative length of the box member. In the region of the tip end of the projections/grooves, the outer radius increases by approximately 0.73% of the root radius and the fourth inwardly tapering frustoconical section 35 has a cone angle of approximately 9.1%.

Connection and release of the box member 2 and pin member 1 of the invention occurs in exactly the same way as with the prior art system described above in connection with FIGS. 1 to 3. In the invention, however, the reduction in the wall thickness formed by the inwardly tapering sections and thickening formed at the tip end of the projections in the box member modifies the thickness profile of the connectors so that the relative displacement under the injection pressure at the ends is closer to that at the mod-span (half way along the teeth). As a result, the release pressure is reduced at the ends, enabling the connector to be released at a lower pressure, eliminating the risk of over-pressuring, whilst avoiding the need to taper the teeth crests as disclosed in the prior art and the disadvantages associated therewith.

Figure 5:
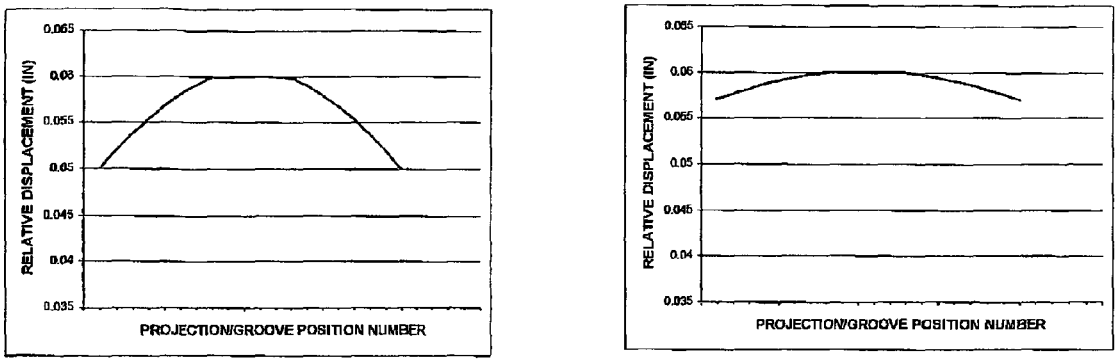
FIG. 5 show various graphs illustrating the improvement in teeth clearance as compared with the prior art.
Figure 5:
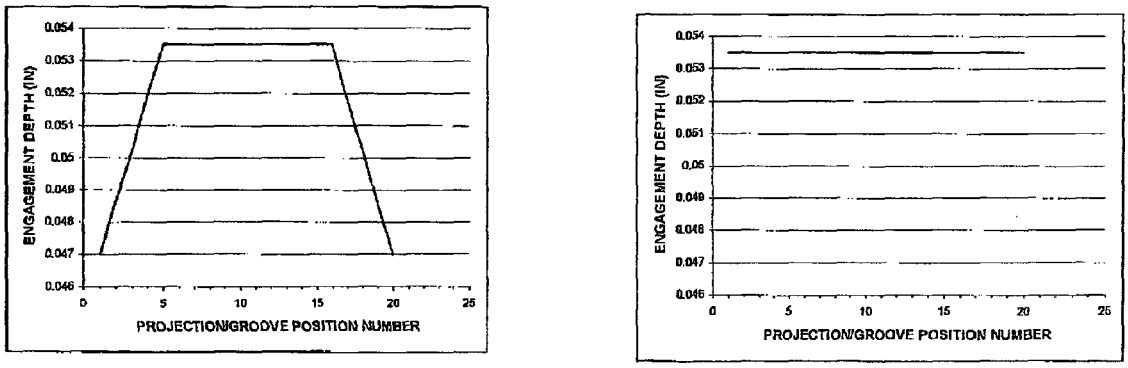
Figure 5:
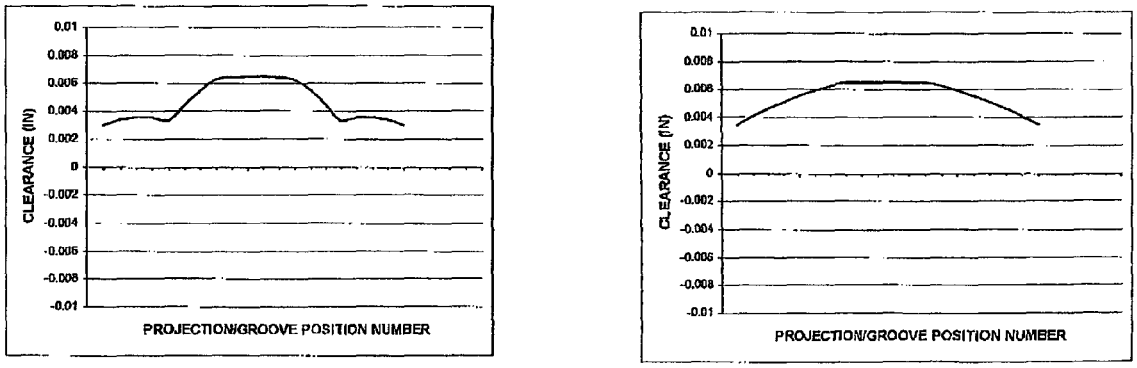

FIG. 5 shows the effect of the present invention on the tooth engagement. FIG. 5(*a*) shows that removal of material at the thicker ends of the pin and box members 1, 2 enables higher total displacement at the end teeth. This means that the tapering of the teeth crests is no longer required (FIG. 5(*b*)) as the clearance during assembly/disassembly is now acceptable (FIG. 5(*c*)).

The invention claimed is:

1. A pipe connector, comprising:

a tubular pin member having a generally frustoconical outer surface forming an engagement surface thereof, and a tubular inner surface opposite the engagement surface, a tubular box member having a generally frustoconical inner surface forming an engagement surface thereof which corresponds to, and overlies, the engagement surface of the pin member when the members are fully engaged together, and a tubular outer surface opposite the engagement surface, the members having inter-engageable annular projections and grooves on the engagement surfaces for axially locking the members together when they are fully engaged together, the projections and grooves being spaced apart along the engagement surfaces, means for supplying hydraulic fluid under pressure between the overlying parts of the surfaces of the members when fully engaged together to expand the box member and/or contract the pin member to bring the projections out of engagement with the corresponding grooves and permit the members to be disengaged, and means for radially restraining the free end of one of the members, wherein at least one of the inner surface of the pin member and the outer surface of the box member includes at least one of a recess and a protrusion which reduces and/or increases the thickness of the tubular wall along the length of the at least one member so as to balance the displacement of the at least one member at different points along the length thereof under injection pressure, and wherein the at least one recess or protrusion is formed by inwardly and outwardly tapering sections in the respective surface of the respective member.

2. A pipe connector according to claim 1, wherein the protrusion is a radially enlarged section.

3. A pipe connector, comprising:

a tubular pin member having a generally frustoconical outer peripheral surface, a tubular box member having a generally frustoconical inner peripheral surface corresponding to the frustoconical outer peripheral surface of the pin member and which overlies the frustoconical surface of the pin member when the members are fully engaged together, the members being provided with inter-engageable annular projections and grooves on the said peripheral surfaces for axially locking the members together when they are fully engaged together, the projections and grooves being spaced apart along the surfaces, means for supplying hydraulic fluid under pressure between the overlying parts of the surfaces of the members when fully engaged together to expand the box member and/or contract the pin member to bring the projections out of engagement with the corresponding grooves and permit the members to be disengaged, and means for radially restraining the free end of one of the members of the connector, wherein at least one of an inner tubular surface of the pin member and an outer tubular surface of the box member includes at least one of a recess and a protrusion which reduces and/or increases the thickness of the tubular wall along the length of the at least one member so as to balance the displacement of the at least one member at different points along the length thereof under injection pressure, and wherein a first section of the inner surface of the pin member, which extends across a root end of the grooves / projections carried on the pin member, tapers outwards and then back inwards so as to form a substantially V shaped channel recessed in the inner tubular surface, which channel extends around the entire periphery of the pin member.

4. A pipe connector according to claim 3, wherein the taper angle of the outwardly tapering portion of the first section is shallower that the taper angle of the inwardly tapering portion of the first section.

5. A pipe connector according to claim 4, wherein the taper angle of the outwardly tapering portion of the first section is 7.1 degrees, and the taper angle of the inwardly tapering portion of the first section is 8.85 degrees.

6. A pipe connector according to claim 3, wherein the taper angle of the outwardly tapering portion of the first section is steeper than a cone angle of the outer frustoconical surface of the pin member formed by the crests of the projections/ grooves.

7. A pipe connector according to claim 6, wherein the cone angle of the outer frustoconical surface of the pin member is substantially 4 degrees.

8. A pipe connector according to claim 3, wherein the inner surface of the pin member includes a second section proximate to the tip of the pin member in which the radius of the inner surface is increased so as to decrease the thickness of the tubular wall of the pin member.

9. A pipe connector according to claim 8, wherein said second section is formed by a steeply outwardly tapering portion which increases the radius of the inner surface followed by a cylindrical portion which extends towards the tip, forming a flat on the inner surface at the increased radius.

10. A pipe connector, comprising:

a tubular pin member having a generally frustoconical outer peripheral surface, a tubular box member having a generally frustoconical inner peripheral surface corresponding to the frustoconical outer peripheral surface of the pin member and which overlies the frustoconical surface of the pin member when the members are fully engaged together, the members being provided with inter-engageable annular projections and grooves on the said peripheral surfaces for axially locking the members together when they are fully engaged together, the projections and grooves being spaced apart along the surfaces, means for supplying hydraulic fluid under pressure between the overlying parts of the surfaces of the members when fully engaged together to expand the box member and/or contract the pin member to bring the projections out of engagement with the corresponding grooves and permit the members to be disengaged, and means for radially restraining the free end of one of the members of the connector, wherein at least one of an inner tubular surface of the pin member and an outer tubular surface of the box member includes at least one of a recess and a protrusion which reduces and/or increases the thickness of the tubular wall along the length of the at least one member so as to balance the displacement of the at least one member at different points along the length thereof under injection pressure, and wherein the outer surface of the box member has a first inwardly tapering portion extending from the root in a tip-wards direction, and a second outwardly tapering portion which extends from the tip end of the first portion towards the tip, the taper angle of said first portion being steeper than the taper angle of said second portion.

11. A pipe connector according to claim 10, wherein the taper angle of the first portion is substantially 7 degrees and the taper angle of the second portion is substantially 2.8 degrees.

12. A pipe connector according to claim 10, wherein said second portion is substantially longer than said first portion.

13. A pipe connector according to claim 10, wherein the radial extent of the second portion is greater than the radial extent of the first portion, such that the second portion terminates at a greater radius than the root end of the first portion.

14. A pipe connector according to claim 10, wherein the outer surface of the box member further includes a third, cylindrical portion, which extends from the tip-wards end of the second portion across the tip end of the projections/ grooves formed on the inner surface of the box member.

15. A pipe connector according to claim 14, wherein the taper angle of the second section is smaller than the taper angle of the crests of the projections carried on the box member.

16. A pipe connector according to claim 15, wherein the taper angle of the crests is substantially 4 degrees.

* * * * *